US005792338A

United States Patent [19]

Gosling et al.

[11] Patent Number: 5,792,338

[45] Date of Patent: *Aug. 11, 1998

[54] BTX FROM NAPHTHA WITHOUT EXTRACTION

[75] Inventors: Christopher D. Gosling, Roselle; Robert S. Haizmann, Rolling Meadows; Bryan K. Glover, Algonquin, all of Ill.

[73] Assignee: UOP, Des Plaines, Ill.

[ * ] Notice: The term of this patent shall not extend beyond the expiration date of Pat. No. 5,472,593.

[21] Appl. No.: 567,663

[22] Filed: Dec. 5, 1995

Related U.S. Application Data

[63] Continuation-in-part of Ser. No. 194,964, Feb. 14, 1994, Pat. No. 5,472,593.

[51] Int. Cl.[6] ..... C10G 35/85

[52] U.S. Cl. ..... 208/65; 208/64; 208/66; 585/322

[58] Field of Search ..... 208/64, 65, 66; 585/322

[56] References Cited

U.S. PATENT DOCUMENTS

| | | | |
|---|---|---|---|
| 4,053,388 | 10/1977 | Bailey | 208/89 |
| 4,157,355 | 6/1979 | Addison | 585/321 |
| 4,181,599 | 1/1980 | Miller et al. | 208/79 |
| 4,645,586 | 2/1987 | Buss | 208/65 |
| 4,808,295 | 2/1989 | Nemet-Mavrodin | 208/65 |
| 4,882,040 | 11/1989 | Dessau et al. | 208/138 |
| 5,037,529 | 8/1991 | Dessau et al. | 208/64 |
| 5,190,638 | 3/1993 | Swan, III et al. | 208/64 |
| 5,472,593 | 12/1995 | Gosling et al. | 585/322 |

*Primary Examiner*—Walter D. Griffin

*Attorney, Agent, or Firm*—Thomas K. McBride; John F. Spears, Jr.; Richard E. Conser

[57] ABSTRACT

A hydrocarbon feedstock is catalytically reformed in a sequence comprising a continuous-reforming zone associated with continuous catalyst regeneration, a zeolitic-reforming zone containing a catalyst comprising a platinum-group metal and a nonacidic L-zeolite and an aromatics-isomerization zone containing a catalyst comprising a platinum-group metal, a metal attenuator and a refractory inorganic oxide. The process combination features high selectivity in producing a high-purity BTX product from naphtha.

16 Claims, 1 Drawing Sheet

BTX FROM NAPHTHA WITHOUT EXTRACTION

CROSS REFERENCE TO RELATED APPLICATION

This application is a continuation-in-part of prior application Ser. No. 08/194,964, filed Feb. 14, 1994, now U.S. Pat. No. 5,472,593, the contents of which are incorporated herein by reference thereto.

BACKGROUND OF THE INVENTION

1. Field of the Invention

This invention relates to an improved process for the conversion of hydrocarbons, and more specifically for the production of aromatic hydrocarbons from naphtha.

2. General Background

Aromatic intermediates BTX (benzene, toluene and xylenes) are obtained principally from petroleum naphtha, using a combination of processes to form and recover the desired aromatics. Catalytic reforming generally is the heart of an aromatics complex, producing a mixture of principally aromatics and paraffins to be processed further by some combination of aromatics extraction, dealkylation or disproportionation, adsorption or crystallization, isomerization and fractionation. The various steps were combined to address the issues of achieving high aromatics purity, balancing the product slate in favor of the relatively higher demand for benzene and xylenes, and dealing with the ethylbenzene contained in the mixed xylenes stream. Substantial improvements have been effected in individual processes contained in such aromatics complexes, particularly in catalytic reforming efficiency for aromatics production and in isomerization for conversion of $C_8$ aromatics.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke. The effectiveness of reforming catalysts comprising a non-acidic L-zeolite and a platinum-group metal for dehydrocyclization of paraffins has been widely disclosed in recent years, but commercialization has been slow.

BTX aromatics produced by catalytic reforming generally are subjected to solvent extraction to remove paraffins, naphthenes and other hydrocarbons. In some cases, when the catalytic reforming process is operated at very high severity particularly on lower-cyclic feedstocks in a manner to convert essentially all of the heavier nonaromatics to aromatics or to lighter compounds, $C_8$ and heavier aromatics may be separated by fractionation without extraction. In any event, aromatics recovered from catalytic reformate by extraction are fractionated to recover pure benzene, toluene and $C_8$ aromatics.

$C_8$ aromatics which have been synthesized and recovered in an aromatics complex contain a mixture of the three xylene isomers and ethylbenzene. Para-xylene normally is recovered in high purity from the $C_8$ aromatics, for example by adsorption or crystallization, and ortho-xylene often is recovered although its markets are more limited. Meta-xylene generally comprises the largest proportion of reformate-derived $C_8$ aromatics, but rarely is recovered in pure form and often is isomerized to increase the yield of para- and/or ortho-xylene. Separation of ethylbenzene from the xylenes by superfractionation or adsorption is very expensive, and ethylbenzene therefore generally is converted in some manner to other products in a process to isomerize associated xylenes.

Since ethylbenzene is relatively difficult to convert in a xylene-isomerization process, catalysts for the upgrading of $C_8$ aromatics to improve isomer distribution ordinarily are characterized by the manner of processing ethylbenzene. A concomitant of older isomerization technology was the transalkylation of ethylbenzene with resulting product loss to heavy aromatics. One modern approach to $C_8$-aromatics isomerization is to react the ethylbenzene in the presence of a solid acid catalyst with a hydrogenation-dehydrogenation function to effect hydrogenation to a naphthene intermediate followed by dehydrogenation to form a xylene mixture. An alternative approach is to convert ethylbenzene via dealkylation to form principally benzene while isomerizing xylenes to a near-equilibrium mixture. The former approach enhances xylene yield by forming xylenes from ethylbenzene, but the latter approach commonly effects higher ethylbenzene conversion and thus lowers the quantity of recycle to the para-xylene recovery unit with a concomitant reduction in processing cost. The latter approach also yields a high-quality benzene product.

The art teaches some combinations of reforming catalysts. U.S. Pat. No. 5,037,529 (Dessau et al.) teaches two-stage reforming with a non-acidic catalyst followed by an acidic catalyst to increase the aromatic content and/or RON of the effluent from the first stage. U.S. Pat. No. 4,645,586 (Buss) discloses a bifunctional catalyst followed by a zeolitic catalyst, but does not suggest continuous reforming.

Other references teach combinations of catalytic reforming and downstream conversion to provide a product enriched in aromatics. U.S. Pat. No. 4,053,388 (Bailey) teaches a combination of catalytic reforming and thermal hydrocracking at 1200°–1380° F. of the reformate to obtain a paraffin stream plus benzene-, toluene, and xylene-rich streams; in the thermal hydrocracking, ethylbenzene is converted at a lower rate than are the xylenes. U.S. Pat. No. 4,157,355 (Addison) discloses catalytic reforming followed by hot flash separation and dealkylation of the separator liquid at 1000°–1500° F. to yield preferably benzene. U.S. Pat. No. 4,181,599 (Miller et al.) discloses reforming and separation of the product to yield a heavy reformate fraction, which is upgraded by conversion with a ZSM-5 catalyst into a BTX-enriched gasoline product. Copending U.S. application Ser. No. 08/194,964 teaches a combination of reforming with a zeolitic catalyst and isomerization of xylenes with conversion of associated ethylbenzene.

SUMMARY OF THE INVENTION

It is an object of the present invention to provide an process combination for the production of aromatics from a hydrocarbon feedstock. A corollary objective is to produce high-purity BTX from naphtha without aromatics extraction.

This invention is based on the discovery that a combination of a catalytic reforming process selective for dehydrocyclization and an aromatics-isomerization process comprising ethylbenzene dealkylation shows surprising BTX product purity and selectivity from naphtha.

A broad embodiment of the present invention is a combination of the catalytic reforming of naphtha utilizing a combination of continuous reforming using a catalyst comprising a platinum-group metal on a refractory inorganic oxide and zeolitic reforming using a catalyst comprising a nonacidic large-pore zeolite to obtain an aromatics-enriched effluent which is processed, without aromatics extraction, through aromatics isomerization utilizing a molecular-sieve catalyst containing an attenuated platinum-group metal to obtain pure BTX having a diminished ethylbenzene content. The combined catalytic-reforming and aromatics-isomerization steps preferably are contained within a single hydrogen circuit, i.e., there is no separation of a hydrogen-containing gas between steps. BTX product may be separated by fractional distillation into pure benzene, toluene and xylenes which are substantially free of nonaromatics and are suitable for further petrochemical conversions. Xylene isomers may be separated with recycle of excess isomers to the aromatics-isomerization step for further conversion to desired isomers.

The catalyst used in continuous reforming preferably comprises platinum on alumina. The large-pore zeolite of the zeolitic reforming catalyst preferably is L-zeolite, especially potassium-form L-zeolite. Each reforming catalyst comprises a platinum-group metal, preferably platinum. The molecular sieve of the aromatics isomerization catalyst preferably is MFI zeolite. The optimum platinum-group metal for the aromatics-isomerization catalyst is platinum, and lead and/or bismuth are preferred as the attenuator.

These as well as other objects and embodiments will become apparent from the detailed description of the invention.

BRIEF DESCRIPTION OF THE DRAWINGS

The FIGURE illustrates the combination of the two catalytic-reforming zones and the aromatics isomerization zone in a single hydrogen circuit.

DESCRIPTION OF THE PREFERRED EMBODIMENTS

Figure 1:
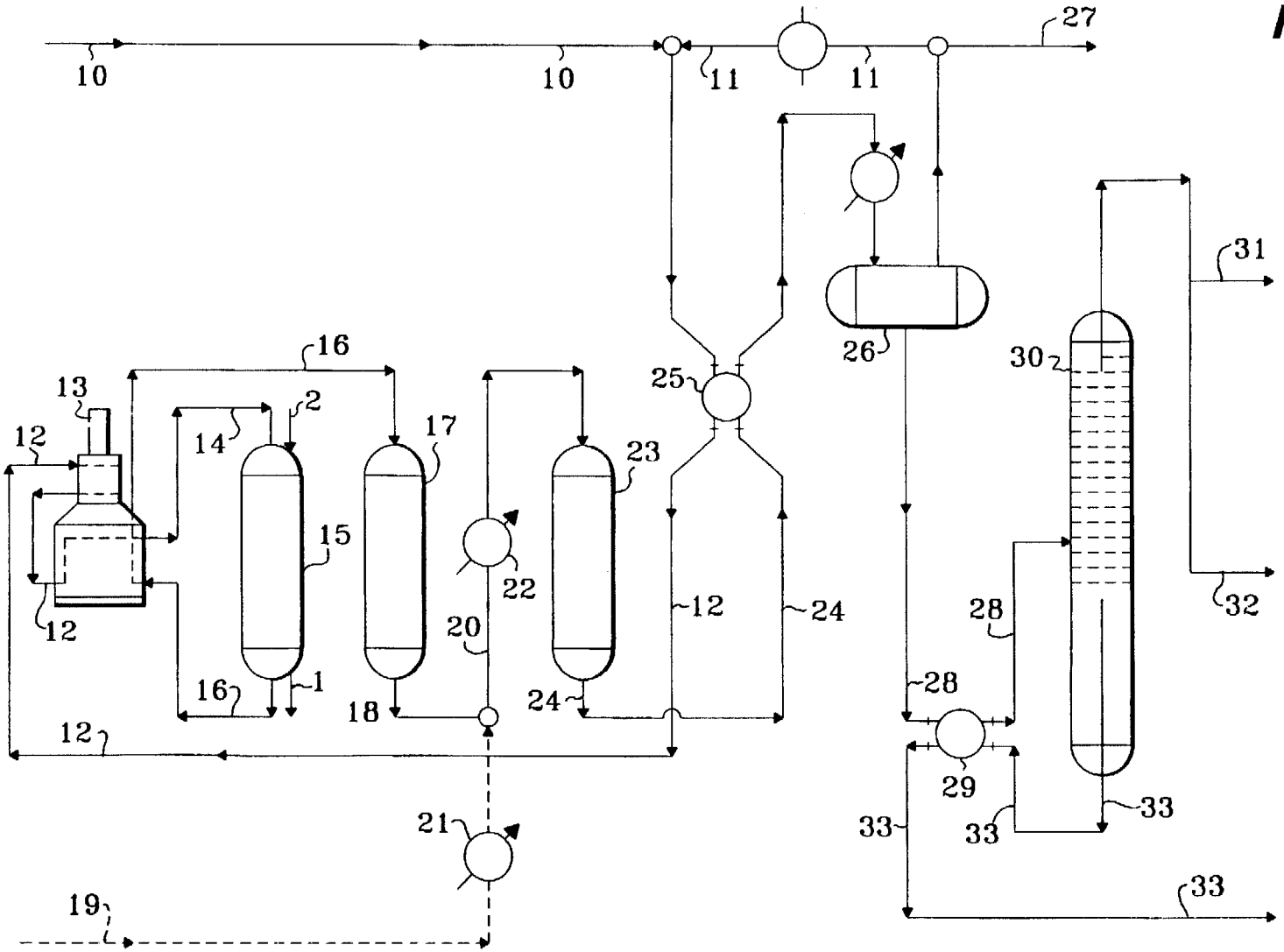

The present invention is broadly directed to a process combination in which a hydrocarbon feedstock is processed in a two successive catalytic-reforming zone, the first based on continuous reforming and the second utilizing a catalyst containing a nonacidic large-pore zeolite, to obtain a reformate which is processed directly thereafter in an aromatics-isomerization zone, utilizing a molecular-sieve catalyst containing an attenuated platinum-group metal, to obtain a pure BTX product.

The preferred embodiment of the invention in which the two reforming zones and aromatics-isomerization zone are contained in the same hydrogen circuit is illustrated in simplified form in the FIGURE. This drawing shows the concept of the invention while omitting details known to the skilled routineer, such as appurtenant vessels, heat exchangers, piping, pumps, compressors, instruments and other standard equipment.

A naphtha feedstock is introduced into the reforming zone of the process combination via line 10, combining with recycled hydrogen-rich gas in line 11 and exchanging heat as combined feed in line 12 with reactor effluent in line 24. The combined feed then is heated in heater 13 and passes via line 14 to the continuous-reforming zone 15. This zone usually comprises two or more reactors with the sequence of heating (to offset endothermic heat of reaction) and further reforming repeated at least once, and more usually twice or three times, depending on the feedstock, reaction conditions and resulting balance of reforming reactions. Substantial dehydrogenation of naphthenes takes place in this reactor, along with isomerization, cracking, and dehydrocyclization principally of heavier paraffins. The reactors often are stacked to enable catalyst to move by gravity between reactors; catalyst is withdrawn to regeneration via line 1 and returned after regeneration and reconditioning as described hereinafter via line 2. Effluent from the continuous-reforming zone passes through line 16 to a heater which raises the temperature of the reactants to levels which are suitable for zeolitic reforming in zone 17, which may comprise a single reactor or multiple reactors with interheating. The principal reaction in this zone, which utilizes a large-pore-zeolite catalyst, is dehydrocyclization of paraffins and especially of hexanes which are not effectively aromatized in the continuous reforming zone.

An aromatics-enriched effluent passes from the last reforming reactor via line 18, and optionally is joined by recycle xylenes in broken line 19 to become feed in line 20 to the aromatics-isomerization zone. Xylenes may be recycled if xylenes produced in the process combination are separated to recover individual xylene isomers, e.g., para-xylene and/or ortho-xylene, and remaining $C_8$-aromatic isomers are returned to the present process for isomerization to a near-equilibrium mixture. The optional recycle xylenes may be preheated via exchanger 21, and the temperature of the combined feed to the aromatics-isomerization zone may be controlled via exchanger 22. Heat may be exchanged in 21 and 22 with other process streams or hot oil or steam, or exchanger 22 in particular may be another heater coil. Aromatics-isomerization feed passes to reactor 23, in which reactions comprising xylene isomerization, ethylbenzene dealkylation, and paraffin hydrocracking take place.

Effluent from aromatics isomerization in line 24 exchanges heat with the reforming-zone feed as discussed above, is cooled in exchanger 25, and passes to separator 26. Most of the hydrogen present in the gas from the separator is recycled to the reforming step via line 11. A lesser portion, amounting nearly to the amount generated by reactions in the reforming zone less that consumed in the aromatics-isomerization zone, is taken as net hydrogen-rich gas via line 27.

Liquid from the separator, optionally after flashing to separate light gases, passes via line 28 through exchanger 29 to fractionator 30, in which light hydrocarbons and hydrogen are removed overhead. Generally pentanes and lighter components are taken overhead from the fractionator, yielding off-gas via line 31 and net overhead liquid via line 32; isohexanes also may be taken overhead without substantial losses of benzene. A concentrated BTX product is taken as fractionator bottoms and, after exchanging heat with fractionator feed in exchanger 29, passes via line 33 usually to additional fractionation to recover pure benzene, toluene and xylenes.

The hydrocarbon feedstock comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically between about 40° and 80° C. and a final boiling point of between about 160° and 210° C., or it may represent a narrower range with a lower final boiling point. Paraffinic feedstocks, such as naphthas from Middle East crudes having a final boiling point of between about 100° and 175° C. are advantageously processed since the process combination effectively dehydrocyclizes paraffins to aromatics. The especially preferred boiling range encompasses $C_6$–$C_8$ naphtha, i.e., an initial boiling point of about 60°–80° C. and a final boiling point of about 140°–160° C., which yield the desired BTX aromatics. Raffinates from aromatics extraction, containing principally low-value $C_6$–$C_8$ paraffins which can be converted to BTX via the present process combination, are favorable alternative hydrocarbon feedstocks.

The hydrocarbon feedstock usually contains small amounts of sulfur compounds, amounting to generally less than 10 mass parts per million (ppm) on an elemental basis. Preferably the hydrocarbon feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(6) and VIII (9–10) of the Periodic Table. [See Cotton and Wilkinson, *Advanced Inorganic Chemistry*, John Wiley & Sons (Fifth Edition, 1988)].

Alternatively or in addition to the conventional hydrotreating, the pretreating step may comprise contact with agents capable of removing sulfurous and other contaminants. These agents may include but are not limited to zinc oxide, iron sponge, high-surface-area sodium, high-surface-area alumina, activated carbons and molecular sieves; excellent results are obtained with a nickel-on-alumina removal agent. Preferably, the pretreating step will provide the reforming catalyst with a hydrocarbon feedstock having low sulfur levels disclosed in the prior art as desirable reforming feedstocks, e.g., 1 ppm to 0.1 ppm (100 ppb). The pretreating step may achieve very low sulfur levels in the hydrocarbon feedstock by combining a relatively sulfur-tolerant reforming catalyst with a sulfur sorbent. The sulfur-tolerant reforming catalyst contacts the contaminated feedstock to convert most of the sulfur compounds to yield an $H_2S$-containing effluent. The $H_2S$-containing effluent contacts the sulfur sorbent, which advantageously is a zinc oxide or manganese oxide, to remove $H_2S$. Sulfur levels well below 0.1 mass ppm may be achieved thereby. It is within the ambit of the present invention that the pretreating step be included in the present reforming process.

Each of the continuous-reforming zone and zeolitic-reforming zone contains one or more reactors containing the respective catalysts. The feedstock may contact the respective catalysts in each of the reactors in either upflow, downflow, or radial-flow mode. Since the present reforming process operates at relatively low pressure, the low pressure drop in a radial-flow reactor favors the radial-flow mode.

First reforming conditions comprise a pressure, consistent with the zeolitic-reforming zone, of from about 100 kPa to 6 MPa (absolute) and preferably from 100 kPa to 1 MPa (abs). Excellent results have been obtained at operating pressures of about 450 kPa or less. Free hydrogen, usually in a gas containing light hydrocarbons, is combined with the feedstock to obtain a mole ratio of from about 0.1 to 10 moles of hydrogen per mole of $C_5$+ hydrocarbons. Space velocity with respect to the volume of first reforming catalyst is from about 0.2 to 10 $hr^{-1}$. Operating temperature is from about 400° to 560° C.

The continuous-reforming zone effects a variety of reactions to produce a first effluent stream. Most of the naphthenes in the feedstock are converted to aromatics. Paraffins in the feedstock are primarily isomerized, hydrocracked, and dehydrocyclized, with heavier paraffins being converted to a greater extent than light paraffins with the latter therefore predominating in the effluent. The aromatics content of the $C_5$+ portion of the effluent is increased by at least 5 mass-% relative to the aromatics content of the hydrocarbon feedstock. The composition of the aromatics depends principally on the feedstock composition and operating conditions, and generally will consist principally of $C_6$–$C_{12}$ aromatics.

During the reforming reaction, catalyst particles become deactivated as a result of mechanisms such as the deposition of coke on the particles to the point that the catalyst is no longer useful. Such deactivated catalyst must be regenerated and reconditioned before it can be reused in a reforming process.

Continuous reforming permits higher operating severity by maintaining the high catalyst activity of near-fresh catalyst through regeneration cycles of a few days. A moving-bed system has the advantage of maintaining production while the catalyst is removed or replaced. Catalyst particles pass by gravity through one or more reactors in a moving bed and are conveyed to a continuous regeneration zone. Continuous catalyst regeneration generally is effected by passing catalyst particles downwardly by gravity in a moving-bed mode through various treatment zones in a regeneration vessel. Although movement of catalyst through the zones is often designated as continuous in practice it is semi-continuous in the sense that relatively small amounts of catalyst particles are transferred at closely spaced points in time. For example, one batch per minute may be withdrawn from the bottom of a reaction zone and withdrawal may take one-half minute; e.g., catalyst particles flow for one-half minute in the one-minute period. Since the inventory in the reaction and regeneration zones generally is large in relation to the batch size, the catalyst bed may be envisaged as moving continuously.

In a continuous-regeneration zone, catalyst particles are contacted in a combustion zone with a hot oxygen-containing gas stream to remove coke by oxidation. The catalyst usually next passes to a drying zone to remove water by contacting a hot, dry air stream. Dry catalyst is cooled by direct contact with an air stream. Optimally, the catalyst also is halogenated in a halogenation zone located below the combustion zone by contact with a gas containing a halogen component. Finally, catalyst particles are reduced with a hydrogen-containing gas in a reduction zone to obtain reconditioned catalyst particles which are conveyed to the moving-bed reactor. Details of continuous catalyst regeneration, particularly in connection with a moving-bed reforming process, are disclosed below and inter alia in U.S. Pat. Nos. 3,647,680; 3,652,231; 3,692,496; and 4,832,921, all of which are incorporated herein by reference.

Spent catalyst particles from the continuous-reforming zone first are contacted in the regeneration zone with a hot oxygen-containing gas stream in order to remove coke which accumulates on surfaces of the catalyst during the reforming reaction. Coke content of spent catalyst particles may be as much as 20% of the catalyst weight, but 5–7% is a more typical amount. Coke comprises primarily carbon with a relatively small amount of hydrogen, and is oxidized to carbon monoxide, carbon dioxide, and water at temperatures of about 450°–550° C. which may reach 600° C. in localized regions. Oxygen for the combustion of coke enters a combustion section of the regeneration zone in a recycle gas containing usually about 0.5 to 1.5% oxygen by volume. Flue gas made up of carbon monoxide, carbon dioxide, water, unreacted oxygen, chlorine, hydrochloric acid, nitrous oxides, sulfur oxides and nitrogen is collected from the combustion section, with a portion being withdrawn from the regeneration zone as flue gas. The remainder is combined with a small amount of oxygen-containing makeup gas, typically air in an amount of roughly 3% of the total gas, to replenish consumed oxygen and returned to the combustion section as recycle gas. The arrangement of a typical combustion section may be seen in U.S. Pat. No. 3,652,231.

As catalyst particles move downward through the combustion section with concomitant removal of coke, a "breakthrough" point is reached typically about halfway through the section where less than all of the oxygen delivered is consumed. It is known in the art that the present reforming catalyst particles have a large surface area associated with a multiplicity of pores. When the catalyst particles reach the breakthrough point in the bed, the coke remaining on the surface of the particles is deep within the pores and therefore the oxidation reaction occurs at a much slower rate.

Water in the makeup gas and from the combustion step is removed in the small amount of vented flue gas, and therefore builds to an equilibrium level in the recycle-gas loop. The water concentration in the recycle loop optionally may be lowered by drying the air that made up the makeup gas, installing a drier for the gas circulating in the recycle gas loop or venting a larger amount of flue gas from the recycle gas stream to lower the water equilibrium in the recycle gas loop.

Optionally, catalyst particles from the combustion zone pass directly into a drying zone wherein water is evaporated from the surface and pores of the particles by contact with a heated gas stream. The gas stream usually is heated to about 425°–600° C. and optionally pre-dried before heating to increase the amount of water that can be absorbed. Preferably the drying gas stream contain oxygen, more preferably with an oxygen content about or in excess of that of air, so that any final residual burning of coke from the inner pores of catalyst particles may be accomplished in the drying zone and so that any excess oxygen that is not consumed in the drying zone can pass upwardly with the flue gas from the combustion zone to replace the oxygen that is depleted through the combustion reaction. Contacting the catalyst particles with a gas containing a high concentration of oxygen also aids in restoring full activity to the catalyst particles by raising the oxidation state of the platinum or other metals contained thereon. The drying zone is designed to reduce the moisture content of the catalyst particles to no more than 0.01 weight fraction based on catalyst before the catalyst particles leave the zone.

Following the optional drying step, the catalyst particles preferably are contacted in a separate zone with a chlorine-containing gas to re-disperse the noble metals over the surface of the catalyst. Re-dispersion is needed to reverse the agglomeration of noble metals resulting from exposure to high temperatures and steam in the combustion zone. Redispersion is effected at a temperature of between about 425°–600° C., preferably about 510°–540°. A concentration of chlorine on the order of 0.01 to 0.2 mol. % of the gas and the presence of oxygen are highly beneficial to promoting rapid and complete re-dispersion of the platinum-group metal to obtain redispersed catalyst particles.

Regenerated and redispersed catalyst is reduced to change the noble metals on the catalyst to an elemental state through contact with a hydrogen-rich reduction gas before being used for catalytic purposes. Although reduction of the oxidized catalyst is an essential step in most reforming operations, the step is usually performed just ahead or within the reaction zone and is not generally considered a part of the apparatus within the regeneration zone. Reduction of the highly oxidized catalyst with a relatively pure hydrogen reduction gas at a temperature of about 450°–550° C., preferably about 480°–510° C., to provide a reconditioned catalyst.

During lined-out operation of the continuous-reforming zone, most of the catalyst supplied to the zone is a dual-function first reforming catalyst which has been regenerated and reconditioned as described above. A portion of the catalyst to the reforming zone may be first reforming catalyst supplied as makeup to overcome losses to deactivation and fines, particularly during reforming-process startup, but these quantities are small, usually less than about 0.1% per regeneration cycle. The first reforming catalyst is a dual-function composite containing a metallic hydrogenation-dehydrogenation, preferably a platinum-group metal component, on a refractory support which preferably is an inorganic oxide which provides acid sites for cracking and isomerization. The first reforming catalyst effects dehydrogenation of naphthenes contained in the feedstock as well as isomerization, cracking and dehydrocyclization.

The refractory support of the first reforming catalyst should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the first reforming catalyst is alumina, with gamma-or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Pural." Ziegler alumina is an extremely high-purity pseudoboehmite which, after calcination at a high temperature, has been shown to yield a high-priority gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g.

The alumina powder may be formed into any shape or form of carrier material known to those skilled in the art such as spheres, extrudates, rods, pills, pellets, tablets or granules. The extrudate form is suitably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass-%. The resulting dough is extruded through a suitably shaped and sized die to form extrudate particles, which are dried and calcined by known methods. Alternatively, spherical particles can be formed from the extrudates by rolling the extrudate particles on a spinning disk.

Spheroidal particles have a diameter of from about 1/16th to about 1/8th inch (1.5–3.1 mm), though they may be as large as 1/4th inch (6.35 mm). In a particular regenerator, however, it is desirable to use catalyst particles which fall in a relatively narrow size range. A preferred catalyst particle diameter is 1/16th inch (3.1 mm).

Preferred spherical particles may be formed directly by the well known oil-drop method, converting the alumina powder into alumina sol by reaction with suitable peptizing acid and water and dropping a mixture of the resulting sol and gelling agent into an oil bath to form particles of an alumina gel which are finished by known aging, drying and calcination steps. This method of forming spherical particles comprises: forming an alumina hydrosol by any of the techniques taught in the art and preferably by reacting aluminum metal with hydrochloric acid; combining the resulting hydrosol with a suitable gelling agent; and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging and drying treatments in oil and an ammoniacal solution to further improve their physical characteristics. The resulting aged and gelled particles are then washed and dried at a relatively low temperature of about 150° to about 205° C. and subjected to a calcination procedure at a temperature of about 450° to about 700° C. for a period of about 1 to about 20 hours. This treatment effects conversion of the alumina hydrogel to the corresponding crystalline gamma-alumina. U.S. Pat. No. 2,620,314 provides for additional details and is incorporated herein by reference thereto.

An essential component of the first reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass-% of the catalytic composite, preferably 0.05 to 1 mass-%, calculated on an elemental basis.

It is within the scope of the present invention that the first reforming catalyst contains a metal promoter to modify the effect of the preferred platinum component. Such metal modifiers may include Group IVA (14) metals, other Group VIII (8–10) metals, rhenium, indium, gallium, zinc, uranium, dysprosium, thallium and mixtures thereof. Excellent results are obtained when the first reforming catalyst contains a tin component. Catalytically effective amounts of such metal modifiers, comprising from about 0.01 to 5 mass-% of the catalyst when present, may be incorporated into the catalyst by any means known in the art.

The first reforming catalyst preferably contains a halogen component. The halogen component may be either fluorine, chlorine, bromine or iodine or mixtures thereof, with chlorine being preferred. The halogen component is generally present in a combined state with the inorganic-oxide support. The halogen component is preferably well dispersed throughout the catalyst and may comprise from more than 0.2 to about 15 wt. %, calculated on an elemental basis, of the final catalyst.

An optional ingredient of the first reforming catalyst is a zeolite, or crystalline aluminosilicate. Preferably, however, this catalyst contains substantially no zeolite component. The first reforming catalyst may contain a non-zeolitic molecular sieve, as disclosed in U.S. Pat. No. 4,741,820 which is incorporated herein in by reference thereto.

The first reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially waterfree reduction step at a temperature of about 300° to 550° C. for 0.5 to 10 hours or more. Further details of the preparation and activation of embodiments of the first reforming catalyst are disclosed in U.S. Pat. No. 4,677,094 (Moser et al.), which is incorporated into this specification by reference thereto.

The dual-function reconditioned reforming catalyst preferably represents about 20% to 99% by volume of the total catalyst in the present reforming process. The relative volumes of first and zeolitic reforming catalyst depend on product objectives as well as whether the process incorporates previously utilized equipment. If the product objective of an all-new process unit is maximum practical production of benzene and toluene from a relatively light naphtha feedstock, the zeolitic reforming catalyst advantageously comprises a substantial proportion, preferably about 10–60 mass-%, of the total catalyst. If the zeolitic-reforming zone serves principally to convert lighter gasoline-range paraffins from the continuous-reforming zone, on the other hand, the zeolitic reforming catalyst optimally comprises a relatively small proportion of the total catalyst in order to minimize the impact of the new section on the existing continuous-reforming operation. In the latter case, preferably about 55–99 mass-% of the total catalyst volume of the process is represented by the first reforming catalyst.

The first effluent from the continuous-reforming zone passes to a zeolitic-reforming zone for completion of the reforming reactions. Preferably free hydrogen accompanying the first effluent is not separated prior to the processing of the first effluent in the zeolitic-reforming zone, i.e., the continuous- and zeolitic-reforming zones are within the same hydrogen circuit. It is within the scope of the invention that a supplementary naphtha feed is added to the first effluent as feed to the zeolitic-reforming zone to obtain a supplementary reformate product. The supplementary naphtha feed has characteristics within the scope of those described for the hydrocarbon feedstock, but optimally is lower-boiling and thus more favorable for production of lighter aromatics than the feed to the continuous-reforming zone. The first effluent, and optionally the supplementary naphtha feed, contact a zeolitic reforming catalyst at second reforming conditions in the zeolitic-reforming zone.

The zeolitic catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst as described hereinabove; or: (4) a hybrid system with semiregenerative and continuous-regeneration provisions in the same zone. The preferred embodiment of the present invention is a hybrid system of a fixed-bed reactor in a semiregenerative zeolitic-reforming zone associated with the moving-bed reactor with continuous catalyst regeneration in the continuous-reforming zone.

The hydrocarbon feedstock contacts the zeolitic reforming catalyst in the zeolitic-reforming zone to effect aromatization, i.e., to enrich the aromatics content of the feed to the aromatics-isomerization zone. zeolitic-reforming conditions used in the zeolitic-reforming zone of the present invention include a pressure of from about 100 kPa to 6 MPa (absolute), with the preferred range being from 100 kPa to 2 MPa and a pressure of about 1 MPa or below being especially preferred. Free hydrogen is supplied to the zeolitic-reforming zone in an amount sufficient to correspond to a ratio of from about 0.1 to 10 moles of hydrogen per mole of hydrocarbon feedstock. By "free hydrogen" is meant molecular $H_2$, not combined in hydrocarbons or other compounds. The volume of the contained zeolitic reforming catalyst corresponds to a liquid hourly space velocity of from about 0.5 to 40 $hr^{-1}$.

The operating temperature, defined as the maximum temperature of the combined hydrocarbon feedstock, free hydrogen, and any components accompanying the free hydrogen, generally is in the range of 260° to 560° C. This temperature is selected to achieve optimum overall results from the combination of the zeolitic-reforming and aromatics-isomerization zones with respect to yield and distribution of aromatics in the product as well as to the nature and amount of remaining nonaromatics. Hydrocarbon types in the feed stock also influence temperature selection, as the zeolitic reforming catalyst is particularly effective for dehydrocyclization of light paraffins. Naphthenes generally are dehydrogenated to a large extent in the reforming reactor with a concomitant decline in temperature across the catalyst bed due to the endothermic heat of reaction. Initial reaction temperature generally is slowly increased during each period of operation to compensate for the inevitable catalyst deactivation. The temperature to the reactors of the zeolitic-reforming and aromatics-isomerization zones optimally are staggered, i.e., differ between reactors, in order to achieve product objectives with respect to such variables as ratios of the different aromatics and concentration of nonaromatics. Usually the maximum temperature in the reforming zone is higher than that in the aromatics-isomerization zone, but the temperature in the zeolitic-reforming zone may be lower depending on catalyst condition and product objectives.

Depending on the extent to which paraffin conversion is effected in the continuous-reforming zone, the zeolitic-reforming zone may comprise a single reactor or multiple reactors containing the zeolitic-reforming catalyst. Since a major reaction occurring in the zeolitic-reforming zone is the dehydrocyclization of paraffins to aromatics along with the usual dehydrogenation of naphthenes the resulting endothermic heat of reaction may cool the reactants below the temperature at which reforming takes place before sufficient dehydrocyclization has occurred. Therefore, this zone usually comprises two or more reactors with interheating between reactors to raise the temperature and maintain dehydrocyclization conditions.

Alternatively, zeolitic-reforming temperature may be maintained within the zeolitic-reforming zone by inclusion of heat-exchange internals in a reactor of the zone. U.S. Pat. No. 4,810,472, for example, teaches a bayonet-tube arrangement for externally heating a reformer feed that passes through catalyst on the inside of the bayonet tube. U.S. Pat. No. 4,743,432 discloses a reactor having catalyst for the production of methanol disposed in beds with cooling tubes passing through the beds for removal of heat. U.S. Pat. No. 4,820,495 depicts an ammonia- or ether-synthesis reactor having elongate compartments alternatively containing catalyst with reactants and a heat carrier fluid. Preferably a heat-exchange reactor is a radial-flow arrangement with flow channels in the form of sectors which are contained in an annular volume of the reactor; a heat-exchange medium and reactants contacting catalyst flow radially through alternate channels, optimally in a countercurrent arrangement. An arrangement of webs supports thin-wall heat-exchange plates and provides flow-distribution and -collection chambers on the inner and outer periphery of the channels.

The zeolitic-reforming zone produces an aromatics-enriched effluent, with the aromatics content of the $C_5$+ portion increased by at least 5 mass-% relative to the aromatics content of the first effluent. The composition of the aromatics will depend principally on the feedstock composition and operating conditions, and generally will be within the range of $C_6$–$C_{12}$. Benzene, toluene and $C_8$ aromatics are the primary aromatics produced from the preferred light naphtha and raffinate feedstocks.

The zeolitic reforming catalyst contains a non-acidic large-pore molecular sieve, an alkali-metal component and a platinum-group metal component. The large-pore molecular sieve generally has a maximum free channel diameter or "pore size" of 6 Å or larger, and preferably have a moderately large pore size of about 7 to 8 Å. Such molecular sieves include those characterized as AFI, BEA, FAU or LTL structure type by the IUPAC Commission on Zeolite Nomenclature, with the LTL structure corresponding to L-zeolite being preferred. It is essential that the preferred L-zeolite be non-acidic, as acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

It is necessary to composite the L-zeolite with a binder in order to provide a convenient form for use in the catalyst particles of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass-% sulfate salts, and has a BET surface area of from about 120 to 160 $m^2/g$.

The L-zeolite and binder may be composited to form particle shapes known to those skilled in the art such as spheres, extrudates, rods, pills, pellets, tablets or granules, with extrudates being preferred. In one method of forming extrudates, potassium-form L-zeolite and amorphous silica are commingled as a uniform powder blend prior to introduction of a peptizing agent. An aqueous solution comprising sodium hydroxide is added to form an extrudable dough. The dough preferably will have a moisture content of from 30 to 50 mass-% in order to form extrudates having acceptable integrity to withstand direct calcination. The resulting dough is extruded through a suitably shaped and sized die to form extrudate particles, which are dried and calcined generally by known methods. Preferably, extrudates are subjected directly to calcination without an intermediate drying step in order to encapsulate potassium ions and preserve basicity. The calcination of the extrudates is effected in an oxygen-containing atmosphere at a temperature of from about 260° to 650° C. for a period of about 0.5 to 2 hours.

A zeolitic-reforming-catalyst support may incorporate other porous, adsorptive, high-surface-area materials. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups.

An alkali metal component is a highly preferred constituent of the zeolitic reforming catalyst particles. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic L-zeolite as described hereinabove. Surface-deposited alkali metal also may be present as described in U.S. Pat. No. 4,619,906, incorporated herein by reference thereto.

The platinum-group metal component is another essential feature of the zeolitic-reforming catalyst, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.05 to 5 mass-% of the catalytic composite, preferably 0.05 to 2 mass-%, calculated on an elemental basis.

The platinum-group metal component may be incorporated into the catalyst composite in any suitable manner. The preferred method of preparing the catalyst normally involves the utilization of a water-soluble, decomposable compound of a platinum-group metal to impregnate the calcined zeolite/binder composite. For example, the platinum-group metal component may be added to the calcined hydrogel by commingling the calcined composite with an aqueous solution of chloroplatinic or chloropalladic acid or other such water-soluble compounds. It generally is preferred to impregnate the carrier material after it has been calcined in order to minimize the risk of loss of the valuable platinum-group metal.

It is within the scope of the present invention that the catalyst may contain other metal components known to modify the effect of the preferred platinum component. Such metal modifiers may include Group IVA(14) metals, other Group VIII(8–10) metals, rhenium, indium, gallium, zinc, uranium, thallium and mixtures thereof. Catalytically effective amounts of such metal modifiers may be incorporated into the catalyst by any means known in the art. Preferably the metal modifier is a multimetallic, multigradient Group VIII (8–10) ["Group VIII"] noble-metal component. "Multigradient" designates the differing distribution of two or more Group VIII noble metals in the catalyst particle. At least one metal suitably is present as a "surface-layer" component as described hereinbelow, while one or more other metals is uniformly dispersed throughout the catalyst particle.

The final zeolitic reforming catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the zeolitic reforming catalyst are disclosed, e.g., in U.S. Pat. Nos. 4,619,906 (Lambert et al) and 4,822,762 (Ellig et al.), which are incorporated into this specification by reference thereto.

It is within the scope of the invention that the zeolitic-reforming zone is divided to provide a first sub-zone containing a catalyst system comprising a physical mixture of a zeolitic reforming catalyst and a sulfur sorbent comprising a manganese component, followed by a second sub-zone containing only the zeolitic reforming catalyst. This catalyst system has been found to be surprisingly effective, in comparison to the prior art in which the reconditioned reforming catalyst and sulfur sorbent are utilized in sequence, in removing sulfur from the hydrocarbon feedstock while effecting reforming with emphasis on dehydrocyclization. The co-action of the catalyst and sorbent provides excellent results in achieving favorable yields with high catalyst utilization in a dehydrocyclization operation using a sulfur-sensitive catalyst.

The total first and zeolitic reforming catalysts preferably represent about 5 to 95 mass-% of the total catalyst in the present process combination. The relative volumes of reforming and aromatics-isomerization catalyst depend on product objectives as well as whether the process incorporates previously utilized equipment. The aromatics-enriched first effluent from the zeolitic-reforming zone passes to an aromatics-isomerization zone primarily for conversion of nonaromatics and ethylbenzene. Preferably free hydrogen accompanying the aromatics-enriched effluent is not separated prior to the processing of the reformate in the aromatics-isomerization zone, i.e., the zeolitic-reforming and aromatics-isomerization zones are within the same hydrogen circuit. The alkylaromatics isomerization zone yields a concentrated BTX product.

In the alkylaromatics-isomerization zone, an alkylaromatic hydrocarbon feedstock, preferably in admixture with hydrogen, is contacted in a reactor with a catalyst of the type hereinafter described. Contacting may be effected using the catalyst in a fixed-bed system, a moving-bed system, or a fluidized-bed system, with a fixed-bed system being preferred. In this system, a hydrogen-rich gas and the feedstock are preheated by suitable heating means to the desired reaction temperature and the combined reactants then pass into a reaction zone containing a fixed bed of the catalyst previously characterized. The reaction zone may be one or more separate reactors with suitable means therebetween to ensure that the desired isomerization temperature is maintained at the entrance to each reactor. It is to be noted that the reactants may be contacted with the catalyst bed in either upward, downward, or radial-flow fashion, and that the reactants may be in the liquid phase, a mixed liquid-vapor phase, or a vapor phase when contacted with the catalyst.

Operating conditions in the alkylaromatics-isomerization zone include a temperature in the range of from about 100° to about 600° C. and a pressure of from 100 kPa to about 7 MPa. Preferably, a temperature range of about 300° to 500° C. and a pressure range of about 100 kPa to 3 MPa is employed. The liquid hourly hydrocarbon space velocity of the feedstock relative to the volume of catalyst is from about 0.2 to 100 $hr^{-1}$, more preferably no more than about 30 $hr^{-1}$, and most preferably from about 0.5 to 15 $hr^{-1}$. The hydrocarbon is passed into the reaction zone preferably in admixture with a gaseous hydrogen-containing stream at a hydrogen-to-hydrocarbon mole ratio of from about 0.5 to 15 or more, and preferably a ratio of from about 0.5 to 10. Other inert diluents such as nitrogen, argon, methane, ethane, and the like may be present.

The aromatics-isomerization catalyst of the present invention preferably comprises a platinum-group metal component, a metal attenuator, at least one medium-pore molecular sieve and an inorganic binder. Preferably, the medium-pore molecular sieve is a pentasil zeolite. In a preferred embodiment, the attenuator comprises a lead or bismuth component.

The present catalyst contains at least one medium-pore molecular sieve. The term "medium-pore" refers to the pore size as determined by standard gravimetric adsorption techniques in the art of the referenced crystalline molecular sieve between what is recognized in the art as "large pore" and "small pore," see Flanigen et al, in a paper entitled, "Aluminophosphate Molecular Sieves and the Periodic Table", published in the "New Developments in Zeolite Science and Technology" Proceedings of the 7th International Zeolite Conference, edited by Y. Murakami, A. Iijima and J. W. Ward, pages 103–112 (1986). Intermediate-pore crystalline molecular sieves have pore sizes between 0.4 nm and 0.8 nm, especially about 0.6 nm. For the purposes of this invention, crystalline molecular sieves having pores between about 5 and 6.5 Å are defined as "medium-pore" molecular sieves.

The term "pentasil" of the preferred pentasil zeolite component is used to describe a class of shape-selective zeolites. This novel class of zeolites is well known to the art and is typically characterized by a silica/alumina mole ratio of at least about 12. Descriptions of the pentasils may be found in U.S. Pat. Nos. 4,159,282; 4,163,018; and 4,278,565, all of which are incorporated herein by reference. Of the pentasil zeolites, the preferred ones are MFI, MEL, MTW, MTT and FER (IUPAC Commission on Zeolite Nomenclature), with MFI being particularly preferred. It is a preferred embodiment of the present invention that the pentasil be in the hydrogen form. Conversion of an alkali metal form pentasil to the hydrogen form may be performed by treatment with an aqueous solution of a mineral acid. Alternatively, hydrogen ions can be incorporated into the pentasil by ion exchange with ammonium hydroxide followed by calcination.

The relative proportion of pentasil zeolite in the catalyst composite may range from about 1 to about 20 mass-%, with 5 to 15 mass-% preferred. There is a tradeoff between the zeolite content of the catalyst composite and the pressure and temperature of an isomerization operation in maintaining low xylene losses. In the preferred embodiment, higher pressure requires higher temperature and lower zeolite content in order to avoid saturation and subsequent hydrocracking of aromatic compounds. The balance of the three parameters may result in a different optimum zeolite content for an isomerization unit designed after the present invention than for an existing unit with fixed pressure and temperature limitations.

It is also within the scope of the present invention that the particular pentasil selected may be a gallosilicate, having essentially the same structure as the preferred zeolites described hereinabove except that all or part of the aluminum atoms in the aluminosilicate crystal framework are replaced by gallium atoms. This substitution of the aluminum by gallium in a pentasil zeolite is usually performed prior to or during synthesis of the zeolite to effect a gallium content, expressed as mole ratios of $SiO_2$ to $Ga_2O_3$, of from 20:1 to 400:1 or more.

An alternative component of the catalyst of the present invention is at least one non-zeolitic molecular sieve, also characterized as "NZMS" and defined in the instant invention to include molecular sieves containing framework tetrahedral units ($TO_2$) of aluminum ($AlO_2$), phosphorus ($PO_2$) and at least one additional element (EL) as a framework tetrahedral unit ($ELO_2$). "NZMS" includes the "SAPO" molecular sieves of U.S. Pat. No. 4,440,871, "ELAPSO" molecular sieves as disclosed in U.S. Pat. No. 4,793,984 and certain "MeAPO", "FAPO", "TAPO" and "ELAPO" molecular sieves, as hereinafter described. Crystalline metal aluminophosphates (MeAPOs where "Me" is at least one of Mg, Mn, Co and Zn) are disclosed in U.S. Pat. No. 4,567,029, crystalline ferroaluminophosphates (FAPOs) are disclosed in U.S. Pat. No. 4,554,143, titanium aluminophosphates (TAPOs) are disclosed in U.S. Pat. No. 4,500,651, metal aluminophosphates wherein the metal is As, Be, B, Cr, Ga, Ge, Li or V are disclosed in U.S. Pat. No. 4,686,093, and binary metal aluminophosphates are described in Canadian Patent 1,241,943. ELAPSO molecular sieves also are disclosed in patents drawn to species thereof, including but not limited to COAPSO as disclosed in U.S. Pat. No. 4,744,970, MnAPSO as disclosed in U.S. Pat. No. 4,793,833, CrAPSO as disclosed in U.S. Pat. No. 4,738,837, BeAPSO as disclosed in U.S. Pat. No. 4,737,353 and GaAPSO as disclosed in U.S. Pat. No. 4,735,806. The aforementioned patents are incorporated herein by reference thereto. The nomenclature employed herein to refer to the members of the aforementioned NZMSs is consistent with that employed in the aforementioned applications or patents. A particular member of a class is generally referred to as a "–n" species wherein "n" is an integer, e.g., SAPO-11, MeAPO-11 and ELAPSO-31.

A catalytic composition preferably is prepared by combining the molecular sieves of the invention with a binder for convenient formation of catalyst particles. The binder should be porous, adsorptive support having a surface area of about 25 to about 500 $m^2/g$, uniform in composition and relatively refractory to the conditions utilized in the hydrocarbon conversion process. The term "uniform in composition" denotes a support which is unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention carrier materials which have traditionally been utilized in hydrocarbon conversion catalysts such as: (1) refractory inorganic oxides such as alumina, titanium dioxide, zirconium dioxide, chromium oxide, zinc oxide, magnesia, thoria, boria, silica-alumina, silica-magnesia, chromia-alumina, alumina-boria, silica-zirconia, etc.; (2) ceramics, porcelain, bauxite; (3) silica or silica gel, silicon carbide, clays and silicates including those synthetically prepared and naturally occurring, which may or may not be acid treated, for example attapulgus clay, diatomaceous earth, fuller's earth, kaolin, kieselguhr, etc.; (4) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations, (5) spinels such as $MgAl_2O_4$, $FeAl_2O_4$, $ZnAl_2O_4$, $CaAl_2O_4$, and other like compounds having the formula $MO-Al_2O_3$ where M is a metal having a valence of 2; and (6) combinations of materials from one or more of these groups.

The preferred matrices for use in the present invention are refractory inorganic oxides, with best results obtained with a binder comprising alumina. Suitable aluminas are the crystalline aluminas known as the gamma-, eta-, and theta-aluminas. Excellent results are obtained with a matrix of substantially pure gamma-alumina. In addition, in some embodiments, the alumina matrix may contain minor proportions of other well known refractory inorganic oxides such as silica, zirconia, magnesia, etc. Whichever type of matrix is employed, it may be activated prior to use by one or more treatments including but not limited to drying, calcination, and steaming.

Using techniques commonly known to those skilled in the art, the present catalytic composition may be composited and shaped into any useful form such as spheres (as described hereinabove), pills, cakes, extrudates, powders, granules, tablets, etc., and utilized in any desired size. These shapes may be prepared utilizing any known forming operations including spray drying, tabletting, spherizing, extrusion, and nodulizing. A preferred shape for the catalyst composite is an extrudate. The well-known extrusion method initially involves mixing of the non-zeolitic molecular sieve, either before or after adding metallic components, with the binder and a suitable peptizing agent to form a homogeneous dough or thick paste having the correct moisture content to allow for the formation of extrudates with acceptable integrity to withstand direct calcination. Extrudability is determined from an analysis of the moisture content of the dough, with a moisture content in the range of from 30 to 50 wt. % being preferred. The dough then is extruded through a die pierced with multiple holes and the extrudate is cut to form preferably cylindrical particles in accordance with techniques well known in the art. A multitude of different extrudate shapes are possible, including, but not limited to, cylinders, cloverleaf, dumbbell and symmetrical and asymmetrical polylobates. It is also within the scope of this invention that the extrudates may be further shaped to any desired form, such as spheres, by any means known to the art.

An essential component of the present catalytic composition is a platinum-group metal including one or more of platinum, palladium, rhodium, ruthenium, osmium, and iridium. The preferred platinum-group metal is platinum. The platinum-group metal component may exist within the final catalyst composite as a compound such as an oxide, sulfide, halide, oxysulfide, etc., or as an elemental metal or in combination with one or more other ingredients of the catalytic composition. It is believed that the best results are obtained when substantially all the platinum-group metal component exists in a reduced state. The platinum-group metal component generally comprises from about 0.01 to about 2 mass-% of the final catalytic composite, calculated on an elemental basis.

The platinum-group metal component may be incorporated into the catalyst composite in any suitable manner. The preferred method of preparing the catalyst normally involves the utilization of a water-soluble, decomposable compound of a platinum-group metal to impregnate the calcined zeolite/binder composite. For example, the platinum-group metal component may be added to the calcined hydrogel by commingling the calcined composite with an aqueous solution of chloroplatinic or chloropalladic acid or other such water-soluble compounds. It generally is preferred to impregnate the carrier material after it has been calcined in order to minimize the risk of loss of the valuable platinum-group metal.

An essential constituent of the present invention is an attenuator, preferably comprising a lead or bismuth component. The lead or bismuth component may be incorporated into the catalytic composite in any suitable manner to effectively disperse this component on the individual moieties of the composite. Suitable methods could include coprecipitation or cogelation with the inorganic oxide binder with or without the zeolite, ion exchange with the inorganic oxide binder, or impregnation of the catalyst at any stage in the preparation. One preferred method of incorporating the lead or bismuth component into the catalytic composite involves the addition of suitable soluble lead compounds such as lead nitrate, lead acetate, lead citrate, lead formate, bismuth nitrate, bismuth acetate, bismuth trichloride, bismuth tribromide, bismuth trioxide and the like to the zeolite-containing hydrosol of the inorganic oxide, and then combining the hydrosol with a suitable gelling agent and dispersing the resulting mixture into an oil bath with subsequent processing as explained in more detail hereinabove. After calcining the gelled hydrosol, there is obtained a binder material having a uniform dispersion of lead or bismuth oxide in an intimate combination principally with the inorganic oxide binder. Another preferred method of incorporating the attenuator into the catalyst composite involves the utilization of a soluble, decomposable compound of lead or bismuth to impregnate and uniformly disperse the lead or bismuth on the composite. In general, the lead component can be impregnated either prior to, simultaneously with, or after the platinum-group metallic component is added to the carrier material. A preferred impregnation solution contains chloroplatinic acid, nitric acid, and lead nitrate.

Regardless of which lead compound is used in the preferred impregnation step, it is important that the lead component be uniformly distributed throughout the carrier material. That is, it is important that the concentration of lead in any reasonably divisible portion of the carrier material be approximately the same. In order to achieve this objective, it is necessary to maintain the pH of the impregnation solution in a range of from 7 to about 1 or less. Good platinum-lead interaction results when the nitric acid content of the impregnated carrier material is from about 3 to about 15 mass-%, and a nitric acid content from about 3 to about 11 mass-% is preferred.

The effective dispersion of the preferred platinum and lead or bismuth components is essential to obtain the selectivity demonstrated by the catalyst of the present invention. It is believed, without limiting the present invention, that effective dispersion of the metals and avoidance of platinum crystallites results in association of the platinum and lead or bismuth with resulting beneficial attenuation of the activity of the platinum. Such attenuation is believed to enhance catalyst selectivity by reducing xylene losses. Optimum interaction between platinum-group metal and attenuator has been estimated for a large number of catalyst formulations and preparation techniques using a microreactor test of the conversion of methylcyclohexane to toluene at 450° C. and 1 atm. pressure, with 1–40% conversion, and preferably 10–30% conversion being a target value. The amount of the lead component is fixed as a function of the amount of platinum-group metal contained in the catalyst composite. More specifically, unanticipated beneficial interaction of the platinum-group-metal component and lead component is effected at an atomic ratio of lead to platinum-group metal of from about 2:1 to 10:1. Best results are obtained at an atomic ratio of lead to platinum-group metal of from about 3:1 to about 5:1.

An alternative constituent of the present catalyst is a bismuth component. This component may be present as an elemental metal, as a chemical compound such as the oxide, sulfide, halide, oxychloride, etc., or as a physical or chemical combination with the porous binder material and/or other components of the catalytic composite. The bismuth component is preferably utilized in an amount sufficient to result in a final catalytic composite containing about 0.01 to 5 wt. % bismuth, calculated on an elemental basis, with best results obtained at a level of about 0.1 to 2 wt. %. The bismuth component may be incorporated in the catalytic composite in any suitable manner to achieve a uniform dispersion.

A preferred constituent of the bimetallic catalyst used in the present invention is a halogen component. Although the precise form of the chemistry of the association of the halogen component with the carrier material is not entirely known, it is customary in the art to refer to the halogen component as being combined with the carrier material or with the other ingredients of the catalyst in the form of the corresponding halide (e.g., as the chloride or the fluoride). This combined halogen may be either fluorine, chlorine, iodine, bromine, or mixtures thereof. Of these, fluorine and, particularly, chlorine are preferred. The halogen may be added to the carrier material in any suitable manner either during preparation of the carrier material or before or after the addition of the other components. For example, the halogen may be added at any stage of the preparation of the carrier material or to the calcined carrier material as an aqueous solution of a suitable decomposable halogen-containing compound such as hydrogen fluoride, hydrogen chloride, hydrogen bromide, ammonium chloride, etc. The halogen component or a portion thereof may be combined with the carrier material during the impregnation of the latter with the platinum-group component; for example, through the utilization of a mixture of chloroplatinic acid and hydrogen chloride. In another situation, the alumina hydrosol which is one of the hereinabove preferred methods to form the alumina carrier material may contain halogen and thus contribute at least a portion of the halogen component to the final composite. In a preferred embodiment, halogen is included in the air atmosphere utilized during the final calcination step to promote dispersion of the platinum-group metal and lead components. The halogen is combined with the carrier material to result in a final composite that contains from about 0.1 to about 1.0 mass-% halogen, calculated on an elemental basis.

Regardless of the details of how the components of the catalyst are combined with the porous carrier material, the catalyst composite is dried at a temperature of from about 100° to about 320° C. for a period of from about 2 to about 24 or more hours. The dried composite is finally calcined at a temperature of from about 400° to about 600° C. in an air atmosphere for a period of from about 0.1 to about 10 hours to convert the metallic compounds substantially to the oxide form. The chloride content of the catalyst is adjusted by including a halogen or halogen-containing compound in the air atmosphere. The use of both chlorine and hydrogen chloride is particularly preferred.

The resultant calcined composite is subjected to a substantially water-free reduction step prior to its use in the conversion of hydrocarbons. This step is designed to insure a uniform and finely divided dispersion of the metallic components. Preferably, substantially pure and dry hydrogen (i.e., less than 20 vol. ppm $H_2O$) is used as the reducing agent in this step. The reducing agent contacts the catalyst at conditions, including a temperature of from about 200° to about 650° C. and for a period of from about 0.5 to about 10 hours, effective to reduce substantially all of the platinum-group metal component to the metallic state.

Using techniques and equipment known in the art, a reformed effluent from the aromatics-isomerization zone usually is passed through a cooling zone to a separation zone. In the separation zone, typically maintained at about 10° to 65° C., a hydrogen-rich gas is separated from a liquid phase. Most of the resultant hydrogen-rich stream optimally is recycled through suitable compressing means back to the reforming zone, with a portion of the hydrogen being available as a net product for use in other sections of a petroleum refinery or chemical plant. The liquid phase from the separation zone is normally withdrawn and processed in a fractionating system in order to adjust the concentration of light hydrocarbons and to produce a concentrated BTX product. The concentrated BTX product contains less than about 1 mass-%, and preferably no more than about 0.1 mass-%, nonaromatics. The BTX product may be further fractionated to separate benzene, toluene and xylene concentrates by well-known techniques. Optionally, certain product species such as ortho-xylene may be recovered from the isomerized product by selective fractionation.

The xylene concentrate from fractionation of the concentrated BTX product has a lower ethylbenzene content than usually is found in $C_8$ aromatics from catalytic reformate, amounting to less than 10 mass-% ethylbenzene, generally no more than about 5 mass-%, and usually about 2 mass-% or less. This low-ethylbenzene xylene stream is an advantageous stock for selective recovery of the para-xylene isomer. Para-xylene may be recovered by crystallization, but selective adsorption is preferred using crystalline aluminosilicates according to U.S. Pat. No. 3,201,491. Improvements and alternatives within the preferred adsorption recovery process are described in U.S. Pat. Nos. 3,626,020, 3,696,107, 4,039,599, 4,184,943, 4,381,419 and 4,402,832, incorporated herein by reference thereto. The xylenes are fed to a para-xylene separation zone, and the para-xylene-depleted raffinate comprising a non-equilibrium mixture of $C_8$ aromatics is fed to the aromatics-isomerization zone, where the xylenes are isomerized to near-equilibrium levels and ethylbenzene is converted principally to benzene. In this process scheme non-recovered $C_8$-aromatic isomers may be recycled to extinction until they are either converted to para-xylene or lost due to side-reactions. Ortho-xylene separation, preferably by fractionation, may be effected prior to para-xylene separation.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

EXAMPLE I

Examples I–III present comparative results of pilot-plant tests to evaluate a combination of continuous and zeolitic reforming when processing a naphtha feedstock comprising principally $C_6$–$C_8$ hydrocarbons. The naphtha feedstock had the following characteristics:

| | | |
|---|---|---|
| Sp. gr. | | 0.7283 |
| ASTM D-86,°C.: | IBP | 75 |
| | 50% | 100 |
| | EP | 137 |
| Volume % | Paraffins | 62.0 |
| | Naphthenes | 28.5 |
| | Aromatics | 9.5 |

The comparative tests were effected over a range of conversions of non-aromatics in the feedstock at corresponding conditions, comparing results from the multi-zone reforming combination applied in the present invention with those from a control. Results are evaluated on the basis of the yields of "BTX aromatics," or benzene/toluene/xylene/ethylbenzene, representing the basic aromatic intermediates, and "$C_8$ aromatics," or xylenes+ethylbenzene, generally considered the target aromatic intermediate on which modern aromatics complexes are sized.

EXAMPLE II

Reforming pilot-plant tests were performed as a control based on the known use of a Catalyst A, a continuously regenerable catalyst comprising 0.29 mass-% platinum and 0.30 mass-% tin on chlorided alumina, to process the $C_6$–$C_8$ feedstock described hereinabove. Operating pressure was about 450 kPa, liquid hourly space velocity was about 2.5 $hr^{-1}$ and molecular hydrogen was supplied at a molar ratio to the feedstock of about 6. Temperature was varied to obtain conversion of nonaromatic hydrocarbons in the range of 45 to 77 mass %. BTX aromatics yields over the range of conversion for this control example are plotted in FIG. 1.

Reforming pilot-plant tests were performed based on a multi-zone reforming combination, processing the $C_6$–$C_8$ feedstock described hereinabove, in which Catalyst A as described in Example II was loaded in front of a Catalyst B comprising 0.82 mass-% platinum on silica-bound L-zeolite. The volumetric ratio of Catalyst A to Catalyst B was 75/25.

The naphtha was charged to the reactor in a downflow operation, thus contacting Catalysts A and B successively. Operating pressure was about 450 kPa, overall liquid hourly space velocity with respect to the combination of catalysts was about 2.5 $hr^{-1}$, and hydrogen was supplied at a molar ratio to the feedstock of about 4.5. Temperature was varied to obtain about 50 to 87 mass % conversion of nonaromatic hydrocarbons.

EXAMPLE III

The yield of BTX aromatics at comparable conversions from the pilot-plant tests described in Example II, relative to the quantity of feedstock, was about 4 to 7 mass-% higher for the combination of Catalysts A and B than for Catalyst A alone. The yield structures of the control Catalyst A and the combination Catalyst A/B of the invention are compared below at an equivalent conversion of 74% of the nonaromatics in the feedstock, expressed as mass-% yield of the designated aromatics:

| | Catalyst A | Catalyst A/B |
|---|---|---|
| Benzene | 9.5 | 13.0 |
| Toluene | 25.0 | 31.0 |
| $C_8$ aromatics | 25.0 | 22.0 |
| Total BTX | 59.5 | 66.0 |

The reforming catalyst combination demonstrated over 10% greater yield of aromatics yields than the control.

EXAMPLE IV

Examples IV–VII present comparative results of pilot-plant tests when processing a feedstock comprising principally $C_6$–$C_8$ hydrocarbons by zeolitic reforming with and without aromatics isomerization. The feedstock on which process comparisons were based was a raffinate from a combination of catalytic reforming followed by aromatics extraction to recover benzene, toluene and $C_8$ aromatics. The characteristics of the feedstock were as follows:

| | | |
|---|---|---|
| Sp. gr. | | 0.692 |
| ASTM D-86, °C.: | IBP | 70 |
| | 10% | 77 |
| | 50% | 86 |
| | 90% | 108 |
| | EP | 136 |
| Mass-% | Paraffins | 90.4 |
| | Naphthenes | 6.8 |
| | Aromatics | 2.8 |

EXAMPLE V

A zeolitic reforming catalyst was prepared according to procedures known in the art for use in the tests described hereinbelow. This catalyst was used alone in a "Reference" process against which the process of the invention was compared.

Platinum was impregnated as tetraamineplatinum chloride (TAPC) onto an extruded silica-bound L-zeolite support to effect a platinum content of 0.82 mass-%, on an elemental basis, of the finished catalyst. The catalyst was finished by oxychlorination at 350° C. in air, using an $HCl/Cl_2$ mixture, and reduction with hydrogen at 350° C.

EXAMPLE VI

An isomerization catalyst was prepared in accordance with the procedures described hereinabove in order to demonstrate the advantages of the present invention. MFI zeolite was added to an alumina sol solution in an amount sufficient to yield a zeolite content in the finished catalyst of about 11 mass-%. The MFI-sol solution was then dispersed as droplets into an oil bath until they set and formed hydrogel spheres. These spheres were removed from the oil bath, water washed with a 0.5% ammonia/water solution, air dried, and calcined at a temperature of about 650° C. These calcined spheres were then co-impregnated with platinum and lead. The impregnated spheres were oxidized and chloride adjusted at 525° C., subjected to a reducing environment of H2 at 565° C., and sulfided with H2S to yield 0.07 mass-% sulfur on the catalyst. The final catalyst consisted essentially of about 11 mass-% MFI zeolite, 0.21 mass-% platinum, 0.67 mass-% lead, and 0.78 mass-% chloride with the remainder being alumina binder.

The above isomerization catalyst was placed in sequence following the zeolitic reforming catalyst of Example V in a 50/50 volumetric ratio for use in a "Combination" process which then was tested in comparison to the "Reference" process based on the Example V catalyst alone.

EXAMPLE VII

Pilot-plant tests were performed, comparing the results of processing the raffinate feedstock of Example IV with a prior-art "Reference" process using the catalyst of Example V in comparison with a "Combination" process using the combination of the reforming catalyst and the isomerization catalyst of Example VI.

Each test was carried out at an operating pressure of 790 KPa absolute in a hydrogen atmosphere at an LHSV of 3.0 and temperature of 493° C. The comparative results were as follows:

| | (Combination) | (Reference) |
|---|---|---|
| $C_6$+ conversion, mass-% | 95 | 67 |
| Yields, mass-% | | |
| Hydrogen | 3.1 | 4.1 |
| $CH_4$—$C_2H_6$ | 9.8 | 4.6 |
| $C_3H_8$—$C_5H_{12}$ | 28.1 | 4.8 |
| $C_6$+ Nonaromatics | 5.0 | 31.4 |
| Benzene | 18.6 | 18.6 |
| Toluene | 28.8 | 29.0 |
| $C_8$ aromatics | 5.9 | 6.4 |
| Heavy aromatics | 0.7 | 1.1 |
| $C_8$-aromatics distribution, mass-% | | |
| Ethylbenzene | 1 | 18 |
| Paraxylene + metaxylene | 74 | 53 |
| Orthoxylene | 25 | 29 |

*Conversion of $C_6$+ nonaromatics in raffinate feedstock

The process "Combination" yields a product which is substantially free of unconverted nonaromatic compounds in the aromatics range compared to the "Reference" process of the prior art. The very low ethylbenzene content of the mixed xylenes facilitates separation and isomerization of this stream to priority products, e.g., para-xylene. The process combination of the invention also offers the potential for incorporating xylene isomerization into the combination as a less-expensive increment, in contrast to the separate facility that would be required in the prior-art process.

We claim:

1. A process combination for the upgrading of a hydrocarbon feedstock to a substantially pure BTX product comprising the steps of:

(a) contacting the hydrocarbon feedstock in the presence of free hydrogen in a continuous-reforming zone with a dual-function reconditioned reforming catalyst comprising a platinum-group metal and a refractory inorganic oxide at first reforming conditions comprising a pressure of from about 100 kPa to 6 MPa, liquid hourly space velocity of from about 0.2 to 10 $hr^{-1}$ and temperature of from about 400° to 560° C. to produce a first effluent and deactivated catalyst particles having coke deposited thereon;

(b) removing the deactivated catalyst particles at least semicontinuously from the continuous-reforming zone and contacting at least a portion of the particles in a continuous-regeneration zone with an oxygen-containing gas at a temperature of about 450°–600° C. to remove coke by combustion and obtain regenerated catalyst particles;

(c) contacting the regenerated catalyst particles in a reduction zone with a hydrogen-containing gas at a temperature of about 450° to 550° C. to obtain reconditioned catalyst particles; and, (d) contacting the first effluent in the presence of free hydrogen in a zeolitic-reforming zone at second reforming conditions comprising a pressure of from about 100 kPa to 6 MPa, a temperature of from 260° to 560° C., and a liquid hourly space velocity of from about 0.5 to 40 $hr^{-1}$ with a zeolitic reforming catalyst comprising a nonacidic L-zeolite, a refractory inorganic oxide and a platinum-group metal component to produce an aromatics-enriched effluent; and, (e) contacting the aromatics-enriched effluent without extraction of aromatics therefrom in an aromatics-isomerization zone at aromatics-isomerization conditions comprising a pressure of from about 100 kPa to 3 MPa, a temperature of from 300° to 500° C., a liquid hourly space velocity of from about 0.2 to 100 $hr^{-1}$ and a hydrogen-to-hydrocarbon mole ratio of from about 0.5 to 15 with an aromatics-isomerization catalyst comprising a zeolite selected from MFI, MEL, MTW, MTT and FER, a refractory inorganic oxide, a platinum-group metal component and a metal attenuator to obtain a concentrated BTX product containing less than about 1 mass-% nonaromatics.

2. The process of claim 1 wherein steps (a), (d) and (e) are effected in the a single hydrogen circuit.

3. The process of claim 1 wherein a hydrogen-to-hydrocarbon mole ratio in each of the continuous-reforming and zeolitic-reforming zones is from about 0.1 to 10.

4. The process of claim 1 wherein the hydrocarbon feedstock, comprising one or both of a naphtha feedstock and a raffinate, has a final boiling point of between about 100° and 175° C.

5. The process of claim 1 wherein the concentrated BTX product contains no more than about 0.1 mass % nonaromatics.

6. The process of claim 1 wherein the xylene portion of the BTX product contains no more than about 5 mass-% ethylbenzene.

7. The process of claim 1 wherein the nonacidic L-zeolite comprises potassium-form L-zeolite.

8. The process of claim 1 wherein the zeolitic reforming catalyst comprises an alkali-metal component.

9. The process of claim 8 wherein the alkali-metal component comprises a potassium component.

10. The process of claim 1 wherein the platinum-group metal component of one or both of the dual-function reconditioned reforming catalyst and the zeolitic reforming catalyst comprises a platinum component.

11. The process of claim 1 wherein the refractory inorganic oxide of the aromatics-isomerization catalyst comprises one or both of silica and alumina.

12. The process of claim 1 wherein the platinum-group metal component of the aromatics-isomerization catalyst comprises a platinum component.

13. The process of claim 1 wherein the metal attenuator of the aromatics-isomerization catalyst comprises a lead component.

14. The process of claim 1 wherein a contaminated feedstock is passed through a precedent desulfurization zone to remove at least sulfur from the contaminated feedstock and produce the hydrocarbon feedstock to the continuous-reforming zone.

15. A process combination for the upgrading of a hydrocarbon feedstock within a single hydrogen circuit to a pure BTX product comprising the steps of:

(a) contacting the hydrocarbon feedstock in the presence of free hydrogen in a continuous-reforming zone with a dual-function reconditioned reforming catalyst comprising a platinum-group metal and a refractory inorganic oxide at first reforming conditions comprising a pressure of from about 100 kPa to 6 MPa, liquid hourly space velocity of from about 0.2 to 10 $hr^{-1}$and temperature of from about 400° to 560° C. to produce a first effluent and deactivated catalyst particles having coke deposited thereon;

(b) removing the deactivated catalyst particles at least semicontinuously from the continuous-reforming zone and contacting at least a portion of the particles in a continuous-regeneration zone with an oxygen-containing gas at a temperature of about 450°–600° C. to remove coke by combustion and obtain regenerated catalyst particles;

(c) contacting the regenerated catalyst particles in a reduction zone with a hydrogen-containing gas at a temperature of about 450° to 550° C. to obtain reconditioned catalyst particles; and, (d) contacting the first effluent in the presence of free hydrogen in a zeolitic-reforming zone at second reforming conditions comprising a pressure of from about 100 kPa to 6 MPa, a temperature of from 260° to 560° C., and a liquid hourly space velocity of from about 0.5 to 40 $hr^{-1}$ with a zeolitic reforming catalyst comprising a nonacidic L-zeolite, a refractory inorganic oxide and a platinum-group metal component to produce an aromatics-enriched effluent; and, (e) contacting the aromatics-enriched effluent without extraction of aromatics therefrom in an aromatics-isomerization zone at aromatics-isomerization conditions comprising a pressure of from about 100 kPa to 3 MPa, a temperature of from 300° to 500° C., a liquid hourly space velocity of from about 0.2 to 100 $hr^{-1}$ and a hydrogen-to-hydrocarbon mole ratio of from about 0.5 to 15 with an aromatics-isomerization catalyst comprising a zeolite selected from MFI, MEL, MTW, MTT and FER, a refractory inorganic oxide, a platinum component and a metal attenuator to obtain a concentrated BTX product containing less than about 1 mass-% nonaromatics.

16. A process combination for the upgrading of a hydrocarbon feedstock within a single hydrogen circuit to a pure BTX product comprising the steps of:

(a) contacting the hydrocarbon feedstock in the presence of free hydrogen in a continuous-reforming zone with a dual-function reconditioned reforming catalyst comprising a platinum-group metal and a refractory inorganic oxide at first reforming conditions comprising a pressure of from about 100 kPa to 6 MPa, liquid hourly space velocity of from about 0.2 to 10 $hr^{-1}$ and temperature of from about 400° to 560° C. to produce a first effluent and deactivated catalyst particles having coke deposited thereon;

(b) removing the deactivated catalyst particles at least semicontinuously from the continuous-reforming zone and contacting at least a portion of the particles in a continuous-regeneration zone with an oxygen-containing gas at a temperature of about 450°–600° C. to remove coke by combustion and obtain regenerated catalyst particles;

(c) contacting the regenerated catalyst particles in a reduction zone with a hydrogen-containing gas at a temperature of about 450° to 550° C. to obtain reconditioned catalyst particles; and, (d) contacting the first effluent in the presence of free hydrogen in a zeolitic-reforming zone at second reforming conditions comprising a pressure of from about 100 kPa to 6 MPa, a temperature of from 260° to 560° C., and a liquid hourly space velocity of from about 0.5 to 40 $hr^{-1}$ with a zeolitic reforming catalyst comprising a nonacidic L-zeolite, a refractory inorganic oxide and a platinum-group metal component to produce an aromatics-enriched effluent; and, (e) contacting the aromatics-enriched effluent without extraction of aromatics therefrom in an aromatics-isomerization zone at aromatics-isomerization conditions comprising a pressure of from about 100 kPa to 3 MPa, a temperature of from 300° to 500° C., a liquid hourly space velocity of from about 0.2 to 100 $hr^{-1}$ and a hydrogen-to-hydrocarbon mole ratio of from about 0.5 to 15 with an aromatics-isomerization catalyst comprising a zeolite selected from MFI, MEL, MTW, MTT and FER, a refractory inorganic oxide, a platinum component and a metal attenuator to obtain a concentrated BTX product containing less than about 1 mass-% nonaromatics;

(f) fractionating the BTX product to obtain benzene, toluene and xylene concentrates; and, (g) separating the xylene concentrate in a para-xylene separation zone to obtain para-xylene and a para-xylene-depleted raffinate, and recycling the raffinate to the aromatics-isomerization zone.

* * * * *